US008972179B2

(12) United States Patent
Brinton et al.

(10) Patent No.: US 8,972,179 B2
(45) Date of Patent: Mar. 3, 2015

(54) METHOD AND APPARATUS TO ANALYZE GPS DATA TO DETERMINE IF A VEHICLE HAS ADHERED TO A PREDETERMINED ROUTE

(76) Inventors: Brett Brinton, Bellevue, WA (US); Charles Michael McQuade, Issaquah, WA (US)

( * ) Notice: Subject to any disclaimer, the term of this patent is extended or adjusted under 35 U.S.C. 154(b) by 1115 days.

(21) Appl. No.: 12/724,232

(22) Filed: Mar. 15, 2010

(65) Prior Publication Data

US 2010/0185479 A1 Jul. 22, 2010

Related U.S. Application Data

(63) Continuation-in-part of application No. 11/675,502, filed on Feb. 15, 2007, now Pat. No. 7,680,595, which is a continuation-in-part of application No. 11/425,222, filed on Jun. 20, 2006, now Pat. No. 7,564,375.

(51) Int. Cl.
*G08G 1/123* (2006.01)

(52) U.S. Cl.
USPC ..... 701/465; 701/416; 340/991; 340/994; 340/988

(58) Field of Classification Search
USPC ..... 701/537, 517, 465, 29.6, 408, 117, 411, 701/414, 33.3, 416; 340/988–989, 991–994
See application file for complete search history.

(56) References Cited

U.S. PATENT DOCUMENTS 3,573,620 A 4/1971 Ashley et al.
3,990,067 A 11/1976 Van Dusen et al. ..... 340/306
(Continued)

FOREIGN PATENT DOCUMENTS

CA 2138378 11/1994 ..... G07C 1/20
CA 2326892 10/1999 ..... G07C 1/20
(Continued)

OTHER PUBLICATIONS

Characterisation of system performance of gps antennas in mobile terminals including environmental effects; Rehman, M.U. ; Gao, Y. ; Chen, X. ; Parini, C.G. ; Ying, Z.; Antennas and Propagation, 2009. EuCAP 2009. 3rd European Conference on; Publication Year: 2009 , pp. 1832-1836.*
(Continued)

*Primary Examiner* — Cuong H Nguyen

(57) ABSTRACT

System and method for analyzing position data from a vehicle equipped with a geographical position system to determine if the vehicle has adhered to a predetermined schedule, where the vehicle is scheduled to arrive at each one of a plurality of predetermined locations during a corresponding predetermined time window, the position data identifying a specific geographical location of the vehicle at a specific point in time. Position data from the vehicle is collected as the vehicle travels to the plurality of different locations, the position data identifying a specific geographical location of the vehicle at a specific point in time. Then the position data is analyzed to determine whether the vehicle was at each predetermined location during the corresponding predetermined time window. An exception report is automatically generated for each instance that the vehicle was not at one of the plurality of predetermined locations during the corresponding time window.

13 Claims, 4 Drawing Sheets

(56) References Cited

U.S. PATENT DOCUMENTS 4,025,791 A 5/1977 Lennington et al. ..... 250/341
4,092,718 A 5/1978 Wendt ..... 364/436
4,258,421 A 3/1981 Juhasz et al. ..... 364/424
4,263,945 A 4/1981 Van Ness ..... 141/98
4,325,057 A 4/1982 Bishop ..... 340/539
4,469,149 A 9/1984 Walkey et al. ..... 141/94
4,602,127 A 7/1986 Neely et al. ..... 379/68
4,651,157 A 3/1987 Gray et al. ..... 342/457
4,658,371 A 4/1987 Walsh et al. ..... 364/550
4,763,356 A 8/1988 Day, Jr. et al. ..... 379/368
4,799,162 A 1/1989 Shinakawa et al. ..... 364/436
4,804,937 A 2/1989 Barbiaux et al. ..... 340/52 F
4,814,711 A 3/1989 Olsen et al. ..... 324/331
4,846,233 A 7/1989 Fockens ..... 141/94
4,897,792 A 1/1990 Hosoi ..... 364/449
4,934,419 A 6/1990 Lamont et al. ..... 141/94
4,935,195 A 6/1990 Palusamy et al. ..... 376/249
5,006,847 A * 4/1991 Rush et al. ..... 340/994
5,058,044 A 10/1991 Stewart et al. ..... 364/551.01
5,068,656 A 11/1991 Sutherland ..... 340/989
5,072,380 A 12/1991 Randelman et al. ..... 364/406
5,120,942 A 6/1992 Holland ..... 235/376
5,128,651 A 7/1992 Heckart ..... 340/433
5,204,819 A 4/1993 Ryan ..... 364/465
5,206,643 A 4/1993 Eckelt ..... 340/932.2
5,223,844 A 6/1993 Mansell et al. ..... 342/357.07
5,243,323 A 9/1993 Rogers ..... 340/433
5,321,629 A 6/1994 Shirata et al. ..... 702/187
5,337,003 A 8/1994 Carmichael et al. ..... 324/402
5,359,522 A 10/1994 Ryan ..... 364/465
5,394,136 A 2/1995 Lammers et al. ..... 340/439
5,399,844 A 3/1995 Holland ..... 235/376
5,442,553 A 8/1995 Parrillo ..... 364/424.04
5,459,304 A 10/1995 Eisenmann ..... 235/380
5,459,660 A 10/1995 Berra ..... 701/33
5,479,479 A 12/1995 Braitberg et al. ..... 379/58
5,488,352 A 1/1996 Jasper ..... 340/431
5,499,182 A 3/1996 Ousborne ..... 364/424.04
5,541,845 A 7/1996 Klein ..... 364/449
5,546,305 A 8/1996 Kondo ..... 364/424.03
5,557,254 A 9/1996 Johnson et al. ..... 340/426
5,557,268 A 9/1996 Hughes et al. ..... 340/933
5,572,192 A 11/1996 Berube ..... 340/574
5,585,552 A 12/1996 Heuston et al. ..... 73/116
5,594,650 A 1/1997 Shah et al. ..... 364/449.1
5,596,501 A 1/1997 Comer et al. ..... 364/464.23
5,600,323 A 2/1997 Boschini ..... 341/173
5,610,596 A 3/1997 Petitclerc ..... 340/825.23
5,623,258 A 4/1997 Dorfman ..... 340/825.08
5,629,678 A 5/1997 Gargano et al. ..... 340/573.4
5,657,010 A * 8/1997 Jones ..... 340/994
5,671,158 A 9/1997 Fournier et al. ..... 345/8
5,680,328 A 10/1997 Skorupski et al. ..... 364/550
5,719,771 A 2/1998 Buck et al. ..... 364/443
5,731,893 A 3/1998 Dominique ..... 359/379
5,732,074 A 3/1998 Spaur et al. ..... 370/313
5,742,915 A 4/1998 Stafford ..... 701/35
5,745,049 A 4/1998 Akiyama et al. ..... 340/870.17
5,758,299 A 5/1998 Sandborg et al. ..... 701/29
5,758,300 A 5/1998 Abe ..... 701/33
5,781,871 A 7/1998 Mezger et al. ..... 701/33
5,794,164 A 8/1998 Beckert et al. ..... 701/1
5,808,565 A 9/1998 Matta et al. ..... 340/994
5,809,437 A 9/1998 Breed ..... 701/29
5,815,071 A 9/1998 Doyle ..... 340/439
5,835,871 A 11/1998 Smith et al. ..... 701/29
5,838,251 A 11/1998 Brinkmeyer et al. .... 340/825.31
5,839,112 A 11/1998 Schreitmueller et al. ..... 705/4
5,867,404 A 2/1999 Bryan ..... 364/550
5,874,891 A 2/1999 Lowe ..... 340/433
5,884,202 A 3/1999 Arjomand ..... 701/29
5,890,061 A 3/1999 Timm et al. ..... 455/404
5,890,520 A 4/1999 Johnson, Jr. ..... 141/94
5,892,346 A * 4/1999 Moroto et al. ..... 318/587
5,913,180 A 6/1999 Ryan ..... 702/45
5,922,037 A 7/1999 Potts ..... 701/29
5,923,572 A 7/1999 Pollock ..... 364/528.17
5,942,753 A 8/1999 Dell ..... 250/338.1
5,956,259 A 9/1999 Hartsell, Jr. et al. ..... 364/528.37
5,987,377 A * 11/1999 Westerlage et al. ..... 701/454
5,995,898 A 11/1999 Tuttle ..... 701/102
6,009,355 A 12/1999 Obradovich et al. ..... 701/1
6,009,363 A 12/1999 Beckert et al. ..... 701/33
6,016,795 A 1/2000 Ohki ..... 123/681
6,024,142 A 2/2000 Bates ..... 141/94
6,025,776 A 2/2000 Matsuura ..... 340/438
6,043,661 A 3/2000 Gutierrez ..... 324/504
6,054,950 A 4/2000 Fontana ..... 342/463
6,061,614 A 5/2000 Carrender et al. ..... 701/33
6,064,299 A 5/2000 Lesesky et al. ..... 340/431
6,070,156 A 5/2000 Hartsell, Jr. ..... 705/413
6,078,255 A 6/2000 Dividock et al. ..... 340/539
6,084,870 A 7/2000 Wooten et al. ..... 370/349
6,092,021 A 7/2000 Ehlbeck et al. ..... 701/123
6,107,915 A 8/2000 Reavell et al. ..... 340/433
6,107,917 A 8/2000 Carrender et al. ..... 340/505
6,112,152 A 8/2000 Tuttle ..... 701/115
6,127,947 A 10/2000 Uchida et al. ..... 340/999
6,128,551 A 10/2000 Davis et al. ..... 700/236
6,128,959 A 10/2000 McGovern et al. ..... 73/660
6,169,938 B1 1/2001 Hartsell, Jr. ..... 700/302
6,169,943 B1 1/2001 Simon et al. ..... 701/29
6,199,099 B1 3/2001 Gershman et al. ..... 709/203
6,202,008 B1 3/2001 Beckert et al. ..... 701/33
6,208,948 B1 3/2001 Klingler et al. ..... 702/183
6,236,911 B1 5/2001 Kruger ..... 701/1
6,240,365 B1 5/2001 Bunn ..... 701/213
6,253,129 B1 6/2001 Jenkins et al. ..... 701/29
6,256,579 B1 7/2001 Tanimoto ..... 701/201
6,259,358 B1 7/2001 Fjordbotten ..... 340/433
6,263,273 B1 7/2001 Henneken et al. ..... 701/51
6,263,276 B1 7/2001 Yokoyama et al. ..... 701/207
6,278,936 B1 8/2001 Jones ..... 701/201
6,285,953 B1 9/2001 Harrison et al. ..... 701/213
6,295,492 B1 9/2001 Lang et al. ..... 701/33
6,330,499 B1 12/2001 Chou et al. ..... 701/33
6,339,745 B1 1/2002 Novik ..... 701/208
6,362,730 B2 3/2002 Razavi et al. ..... 340/438
6,370,454 B1 4/2002 Moore ..... 701/29
6,374,176 B1 * 4/2002 Schmier et al. ..... 701/465
6,396,413 B2 5/2002 Hines et al. ..... 340/825.49
6,411,203 B1 6/2002 Lesesky et al. ..... 340/431
6,411,891 B1 6/2002 Jones ..... 701/201
6,417,760 B1 7/2002 Mabuchi et al. ..... 340/5.3
6,438,472 B1 8/2002 Tano et al. ..... 701/35
6,450,411 B1 9/2002 Rash et al. ..... 236/44 A
6,456,039 B1 9/2002 Lauper et al. ..... 320/107
6,502,030 B2 12/2002 Hilleary ..... 701/207
6,505,106 B1 1/2003 Lawrence ..... 701/35
6,507,810 B2 1/2003 Razavi et al. ..... 703/24
6,529,723 B1 3/2003 Bentley ..... 455/405
6,529,808 B1 3/2003 Diem ..... 701/29
6,539,296 B2 3/2003 Diaz et al. ..... 701/33
6,594,579 B1 7/2003 Lowrey et al. ..... 701/123
6,594,621 B1 7/2003 Meeker ..... 702/185
6,597,973 B1 7/2003 Barich et al. ..... 701/29
6,604,033 B1 8/2003 Banet et al. ..... 701/33
6,608,554 B2 8/2003 Weant et al. ..... 340/431
6,609,082 B2 8/2003 Wagner ..... 702/182
6,614,392 B2 9/2003 Howard ..... 342/357.07
6,616,036 B2 9/2003 Streicher et al. ..... 235/381
6,621,452 B2 9/2003 Knockeart et al. ..... 342/357.09
6,636,790 B1 10/2003 Lightner et al. ..... 701/33
6,664,897 B2 12/2003 Pape et al. ..... 340/573.3
6,671,646 B2 12/2003 Manegold et al. ..... 702/127
6,680,694 B1 1/2004 Knockeart et al. ..... 342/357.09
6,708,113 B1 3/2004 Von Gerlach et al. ..... 701/210
6,714,859 B2 3/2004 Jones ..... 701/201
6,727,818 B1 4/2004 Wildman et al. ..... 340/573.1
6,732,031 B1 5/2004 Lightner et al. ..... 701/33
6,732,032 B1 5/2004 Banet et al. ..... 701/33
6,744,352 B2 6/2004 Lesesky et al. ..... 340/431
6,748,318 B1 * 6/2004 Jones ..... 701/465
6,754,183 B1 6/2004 Razavi et al. ..... 370/254

(56) References Cited

U.S. PATENT DOCUMENTS

| | | | | |
|---|---|---|---|---|
| 6,768,994 | B1 | 7/2004 | Howard et al. | 707/10 |
| 6,801,841 | B2 | 10/2004 | Tabe | 701/29 |
| 6,804,606 | B2 | 10/2004 | Jones | 701/213 |
| 6,804,626 | B2 | 10/2004 | Manegold et al. | 702/182 |
| 6,816,762 | B2 | 11/2004 | Hensey et al. | 701/35 |
| 6,834,259 | B1 | 12/2004 | Nicholson et al. | 702/187 |
| 6,856,820 | B1 | 2/2005 | Kolls | 455/575.9 |
| 6,876,642 | B1 | 4/2005 | Adams et al. | 370/338 |
| 6,879,894 | B1 | 4/2005 | Lightner et al. | 701/33 |
| 6,880,390 | B2 | 4/2005 | Emord | 701/103 |
| 6,894,617 | B2 | 5/2005 | Richman | 340/573.1 |
| 6,899,151 | B1 | 5/2005 | Latka et al. | 141/392 |
| 6,904,359 | B2 * | 6/2005 | Jones | 701/517 |
| 6,909,947 | B2 | 6/2005 | Douros et al. | 701/29 |
| 6,924,750 | B2 | 8/2005 | Flick | 340/989 |
| 6,928,348 | B1 | 8/2005 | Lightner et al. | 701/33 |
| 6,946,953 | B2 | 9/2005 | Lesesky et al. | 340/431 |
| 6,952,645 | B1 | 10/2005 | Jones | 701/201 |
| 6,957,133 | B1 | 10/2005 | Hunt et al. | 701/29 |
| 6,972,668 | B2 | 12/2005 | Schauble | 340/438 |
| 6,988,033 | B1 | 1/2006 | Lowrey et al. | 701/123 |
| 7,027,955 | B2 | 4/2006 | Markwitz et al. | 702/187 |
| 7,048,185 | B2 | 5/2006 | Hart | 235/384 |
| 7,103,460 | B1 | 9/2006 | Breed | 701/29 |
| 7,113,127 | B1 | 9/2006 | Banet et al. | 342/357.09 |
| 7,117,121 | B2 | 10/2006 | Brinton et al. | 702/182 |
| 7,155,199 | B2 | 12/2006 | Zalewski et al. | 455/403 |
| 7,174,243 | B1 | 2/2007 | Lightner et al. | 701/33 |
| 7,174,277 | B2 | 2/2007 | Vock et al. | 702/188 |
| 7,202,801 | B2 * | 4/2007 | Chou | 340/994 |
| 7,225,065 | B1 | 5/2007 | Hunt et al. | 701/29 |
| 7,228,211 | B1 | 6/2007 | Lowrey et al. | 701/29 |
| 7,254,516 | B2 | 8/2007 | Case, Jr. et al. | 702/182 |
| 7,343,252 | B2 | 3/2008 | Wiens | 702/54 |
| 7,362,229 | B2 | 4/2008 | Brinton et al. | 340/572.1 |
| 7,447,574 | B1 | 11/2008 | Washicko et al. | 701/29 |
| 7,477,968 | B1 | 1/2009 | Lowrey et al. | 701/29 |
| 7,480,551 | B1 | 1/2009 | Lowrey et al. | 701/29 |
| 7,523,159 | B1 | 4/2009 | Williams et al. | 709/203 |
| 7,532,962 | B1 | 5/2009 | Lowrey et al. | 701/29 |
| 7,532,963 | B1 | 5/2009 | Lowrey et al. | 701/29 |
| 7,596,437 | B1 | 9/2009 | Hunt et al. | 701/29 |
| 7,604,169 | B2 | 10/2009 | Demere | 235/384 |
| 7,640,185 | B1 | 12/2009 | Giordano et al. | 705/23 |
| 7,650,210 | B2 | 1/2010 | Breed | 701/29 |
| 7,672,756 | B2 | 3/2010 | Breed | 701/29 |
| 7,672,763 | B1 | 3/2010 | Hunt et al. | 701/29 |
| 7,778,752 | B1 | 8/2010 | Hunt et al. | 701/36 |
| 2001/0047283 | A1 | 11/2001 | Melick et al. | 705/8 |
| 2001/0053983 | A1 | 12/2001 | Reichwein et al. | 705/1 |
| 2002/0016655 | A1 | 2/2002 | Joao | 701/35 |
| 2002/0022979 | A1 | 2/2002 | Whipp et al. | 705/5 |
| 2002/0022984 | A1 | 2/2002 | Daniel et al. | 705/8 |
| 2002/0065698 | A1 | 5/2002 | Schick et al. | 705/8 |
| 2002/0107833 | A1 | 8/2002 | Kerkinni | 707/1 |
| 2002/0107873 | A1 | 8/2002 | Winkler et al. | 707/104.1 |
| 2002/0111725 | A1 | 8/2002 | Burge | 701/29 |
| 2002/0122583 | A1 | 9/2002 | Thompson | 382/141 |
| 2002/0133273 | A1 | 9/2002 | Lowrey et al. | 701/29 |
| 2002/0133275 | A1 | 9/2002 | Thibault | 701/35 |
| 2002/0147610 | A1 | 10/2002 | Tabe | 705/1 |
| 2002/0150050 | A1 | 10/2002 | Nathanson | 370/241 |
| 2002/0156558 | A1 | 10/2002 | Hanson et al. | 701/33 |
| 2002/0163449 | A1 | 11/2002 | Flick | 340/988 |
| 2002/0178147 | A1 | 11/2002 | Arroyo et al. | 707/2 |
| 2002/0188593 | A1 | 12/2002 | Moser et al. | 707/1 |
| 2003/0030550 | A1 | 2/2003 | Talbot | 340/433 |
| 2003/0033061 | A1 | 2/2003 | Chen et al. | 701/33 |
| 2003/0109973 | A1 | 6/2003 | Hensey et al. | 701/35 |
| 2003/0120745 | A1 | 6/2003 | Katagishi et al. | 709/217 |
| 2003/0146854 | A1 * | 8/2003 | Jones | 340/988 |
| 2003/0195696 | A1 * | 10/2003 | Jones | 701/201 |
| 2003/0195697 | A1 * | 10/2003 | Jones | 701/201 |
| 2003/0195698 | A1 * | 10/2003 | Jones | 701/201 |
| 2003/0195699 | A1 * | 10/2003 | Jones | 701/201 |
| 2003/0233188 | A1 * | 12/2003 | Jones | 701/200 |
| 2003/0233190 | A1 * | 12/2003 | Jones | 701/207 |
| 2004/0009819 | A1 | 1/2004 | Koga | 464/51 |
| 2004/0236596 | A1 | 11/2004 | Chowdhary et al. | 705/1 |
| 2005/0131625 | A1 * | 6/2005 | Birger et al. | 701/117 |
| 2005/0206534 | A1 * | 9/2005 | Yamane et al. | 340/994 |
| 2005/0273250 | A1 | 12/2005 | Hamilton et al. | 701/200 |
| 2006/0232406 | A1 | 10/2006 | Filibeck | 340/572.1 |
| 2007/0050193 | A1 | 3/2007 | Larson | 705/1 |
| 2007/0069947 | A1 | 3/2007 | Banet et al. | 342/357.09 |
| 2007/0179709 | A1 | 8/2007 | Doyle | 701/209 |
| 2008/0154489 | A1 | 6/2008 | Kaneda et al. | 701/201 |
| 2008/0154712 | A1 | 6/2008 | Wellman | 705/11 |
| 2008/0319665 | A1 | 12/2008 | Berkobin et al. | 701/213 |
| 2009/0069999 | A1 | 3/2009 | Bos | 701/102 |
| 2009/0177350 | A1 | 7/2009 | Williams et al. | 701/29 |
| 2009/0222200 | A1 | 9/2009 | Link, II et al. | 701/202 |
| 2010/0088127 | A1 | 4/2010 | Betancourt et al. | 705/5 |

FOREIGN PATENT DOCUMENTS

| | | | |
|---|---|---|---|
| CA | 2388572 | 3/2001 | G06F 17/60 |
| EP | 0 755 039 | 6/1996 | G08G 1/01 |
| EP | 0 814 447 | 5/1997 | G08G 1/0968 |
| EP | 1 067 498 | 7/2000 | G08G 1/127 |
| EP | 1 271 374 | 6/2002 | G06F 17/60 |
| EP | 0 926 020 | 9/2002 | B60R 25/00 |
| EP | 1 005 627 | 10/2003 | G01C 21/00 |
| EP | 1 027 792 | 1/2004 | H04L 29/06 |
| EP | 2 116 968 | 11/2009 | G06Q 30/00 |
| WO | WO 97/26750 | 7/1997 | H04M 11/00 |
| WO | WO 98/03952 | 1/1998 | G08G 1/127 |
| WO | WO 98/30920 | 7/1998 | |
| WO | WO 03/023550 | 3/2003 | |
| WO | WO 2007/092711 | 8/2007 | |

OTHER PUBLICATIONS

Path Generation Using eta fourth—Splines for a Truck and Trailer Vehicle; Ghilardelli, F. ; Lini, G. ; Piazzi, A.; Automation Science and Engineering, IEEE Transactions on ; vol. 11 , Issue: 1; DOI: 10.1109/TASE.2013.2266962; Publication Year: 2014 , pp. 187-203.*

Datatrak automatic vehicle location and position reporting system; Banks, K.M.; Vehicle Navigation and Information Systems Conference, 1989. Conference Record; DOI: 10.1109/VNIS.1989.98765; Publication Year: 1989 , pp. 214-218.*

Short message service link for automatic vehicle location reporting; Papadoglou, N. ; Stipidis, E.; Electronics Letters vol. 35 , Issue: 11; DOI: 10.1049/el:19990600; Publication Year: 1999 , pp. 876-877.*

Integrated automatic vehicle location and position reporting system; Banks, K.M.; Road Traffic Monitoring, 1989., Second International Conference on; Publication Year: 1989 , pp. 195-199.*

Simulation-based optimization for split delivery vehicle routing problem: A report of ongoing study; Yanchun Pan ; Liang Yan ; Zhimin Chen ; Ming Zhou; Simulation Conference (WSC), 2013 Winter; DOI: 10.1109/WSC.2013.6721498 Publication Year: 2013 , pp. 1089-1096.*

Albright, Brian: "*Indiana Embarks on Ambitious RFID roll out.*" *Frontline Solutions*. May 20, 2002; 2pp. Available at: <http://www.frontlinetoday.com/frontline/article/articleDetail.jsp?id=19358>.

Anonymous. "Transit agency builds GIS to plan bus routes." *American City & County*. vol. 118, No. 4. Published Apr. 1, 2003. 4pp. NDN-258-0053-0664-6.

Contact: GCS (UK), Tewkesbury Gloucestershire. Dec. 11, 2002. 2pp. Copyright © 2000 GCS Control Systems <http://www.gcs.at?eng/newsallegemein.htm>.

"*Detex Announces the Latest Innovation in Guard Tour Verification Technology.*" *DETEX Life Safety, Security and Security Assurance*. Jan. 1, 2003. 1pp. © 2002-2004 Detex Corporation. <http://www.detex.com/NewsAction.jspa?id=3>.

"*D.O.T. Driver Vehicle Inspection Reports on your wireless phone*!" FleeTTrakkeR$_{LLC}$ *2002-2003 FleeTTrakkeR*$_{LLC}$ . All rights reserved <http://www. fleettrakker.com/web/index.jsp> Accessed Mar. 12, 2004.

(56) References Cited

OTHER PUBLICATIONS

Dwyer, H.A., et al. Abstract: "Analysis of the Performance and Emissions of Different Bus Technologies on the city of San Francisco Routes." Technical paper published by Society of Automotive Engineers, Inc. Published Oct. 26, 2004. 2pp. NDN-116-0014-3890-6.
Kurtz, Jennifer. "*Indiana's E-Government: A Story Behind It's Ranking." Incontext Indiana;s Workforce and Economy*. Jan.-Feb. 2003 vol. 4, No. 5pp. Available at <http://www.incontext.indiana.edu/2003/jan-feb03/governement.html>.
"*Nextel, Motorola and Symbol Technologies Offer First Wireless Bar Code Scanner for Mobile Phones*." Jun. 11, 2003. <http://theautochannel.com/news/2003/06/11/162927.htm>.
Quaan et al., "*Guard Tour Systems." Security Management Online*. Sep. 16, 2003. 1pg. © 2000 <http://www.securitymanagement.com/ubb/Forum30/HTML/000066.html>.
Qualcomm. "Object FX Integrates TrackingAdvisor with QUALCOMM's FleetAdvisor System; Updated Version Offers Benefit of Visual Display of Vehicles and Routes to Improve Fleet Productivity." Source: Newswire. Published Oct. 27, 2003. 4pp. NDN-121-0510-3002-5.
Senger, Nancy. "*Inside RF/ID: Carving A Niche Beyond Asset Tracking." Business Solutions*. Feb. 1999: 5pp. Available at: <http://www.businesssolutionsmag.com/Articles/1999_02/990208.html>.
"*The Data Acquisition Unit Escorte." The Proxi Escort.com*. Nov. 20, 2001. 4pp. Copyright © 2000 GCS General Control Systems. <http://www.gcs.at/eng/produkte/hw/escorte.htm>.
"The PenMaster" and "The PSION Workabout." Copyright 2000 GCS General Control Systems. <http://www.gcs.at/eng/produkte/hw/penmaster.htm>.
Tiscor: The Mobile Software Solutions Provider. *Inspection Manager: An Introduction*. Sep. 27, 2004. Slide presentation; 19pp. Available: www.tiscor.com.
Tiscor: *Inspection Manager 6.0 User Guide*. USA; 2004. 1-73.
"Tracking out of route: software helps fleets compare planned routes to actual miles. (Technology)." *Commercial Carrier Journal*. Published Oct. 1, 2005. 4pp. NDN-219-1054-1717-0.
Tsakiri, M et al. Abstract: "Urban fleet monitoring with GPS and GLONASS." *Journal of Navigation*, vol. 51, No. 3. Published Sep. 1998. 2pp. NDN-174-0609-4097-3.
Tuttle, John R. "Digital RF/ID Enhances GPS" Proceedings of the Second Annual Wireless Symposium, pp. 406-411, Feb. 15-18, 1994, Santa Clara, CA.
Want, Roy, "*RFID A Key to Automating Everything." Scientific American*, Jan. 2004, p. 58-65.
"*What is the Child Check-Mate Safety System"? 2002 © Child Checkmate Systems Inc*. <http://www.childcheckmate.com/what.html>.
Leavitt, Wendy, "The Convergence Zone." FleetOwner, 4 pp. <www.driversmag.com/ar/fleet_convergence_zone/index.html> 1998.
Miras. "About SPS Technologies." 1 pg., May 7, 1999.
Miras. "How Miras Works." 1pg., Apr. 29, 1999.
Miras. "Miras 4.0 Screenshot." 1pg., May 7, 1999.
Miras. "Miras Unit." 1pg., May 4, 1999.
Miras. "Monitoring Vehicle Functions." 1pg., Apr. 27, 1999.
Miras. "Remote Control." 1pg., Apr. 29, 1999.
Miras. "Tracking & Monitoring Software." 1pg., Apr. 29, 1999.
Sterzbach et al., "A Mobile Vehicle On-Board Computing and Communication System." Comput. & Graphics, vol. 20, No. 4: 659-667, 1996.
Zujkowski, Stephen. "Savi Technolgy, Inc.: Savi Security and Productivity Systems." ATA Security Forum 2002, Chicago, IL: 21pp., May 15, 2002.
n.a., "Private fleets moving to wireless communications." FleetOwner, 4pp. <www.driversmag.com/ar/fleet_private_fleets_moving/index.html> 1997.
n.a., "MIRAS GPS vehicle tracking using the Internet." Business Wire, 2pp., Nov. 22, 1996.
Guensler et al., "Development of a Comprehensive Vehicle Instrumentation Package for Monitoring Individual Tripmaking Behavior." *Georgia Institute of Technology: School of Civil and Environmental Engineering*: 31pp., Feb. 1999.
Jenkins et al., "Real-Time Vehicle Performance Monitoring Using Wireless Networking." *IASTED International Conference on Communications, Internet, and Information Technology*: 375-380, Nov. 22-24, 2004.
Kwon, W., "Networking Technologies of In-Vehicle." *Seoul National University: School of electrical engineering*: 44pp., Mar. 8, 2000.
"OBD Up." *MOTOR*: 28-34, Jul. 1998.

* cited by examiner

METHOD AND APPARATUS TO ANALYZE GPS DATA TO DETERMINE IF A VEHICLE HAS ADHERED TO A PREDETERMINED ROUTE

RELATED APPLICATIONS

This application is a continuation-in-part of prior application Ser. No. 11/675,502, filed on Feb. 15, 2007 and issued as U.S. Pat. No. 7,680,595 on Mar. 16, 2010, the benefit of the filing date of which is hereby claimed under 35 U.S.C. §120. Prior co-pending application Ser. No. 11/675,502 itself is a continuation-in-part of prior application Ser. No. 11/425,222, filed on Jun. 20, 2006, and issued as U.S. Pat. No. 7,564,375 on Jul. 21, 2009, the benefit of the filing date of which is hereby claimed under 35 U.S.C. §120.

BACKGROUND

As the cost of sensors, communications systems and navigational systems has dropped, operators of commercial and fleet vehicles now have the ability to collect a tremendous amount of data about the vehicles that they operate, including geographical position data collected during the operation of the vehicle.

Vehicle fleet operators often operate vehicles along predefined and generally invariant routes. For example, buses frequently operate on predefined routes, according to a predefined time schedule (for example, along a route that is geographically, as well as temporally defined). Determining the performance of a driver operating on such a predefined route can be a tedious task.

It would be desirable to provide such fleet operators with additional means for evaluating driver performance using data (such as Global Positioning System (GPS) data) collected from vehicles traversing a predefined route.

SUMMARY

One aspect of the novel concepts presented herein is a method of using data collected in connection with operation of a vehicle to evaluate a driver's performance while traversing the predefined route. Such a method is intended to be used in conjunction with routes where a vehicle is tasked with arriving at a plurality of predetermined locations, such that the vehicle is intended to arrive at each predetermined location during a corresponding predetermined time window.

In at least one exemplary embodiment, position data from the vehicle is collected as the vehicle travels to the plurality of different locations, the position data identifying a specific geographical location of the vehicle at a specific point in time. Then the position data is analyzed to determine whether the vehicle was at each predetermined location during the corresponding predetermined time window. Next, an exception report is automatically generated for each instance that the vehicle was not at one of the plurality of predetermined locations during the corresponding time window.

In a related embodiment, the step of analyzing the position data to determine whether the vehicle was at each predetermined location during the corresponding predetermined time window includes the steps of determining an actual geographic position of the vehicle during each time window, and comparing the actual geographic position of the vehicle with the plurality of predetermined locations, such that an exception report will be generated when the actual geographic position of the vehicle during the time window does not correspond to one of the plurality of predetermined locations.

If desired, no exception report can be generated if the vehicle arrived at the corresponding predetermined location early.

In another related embodiment, the step of analyzing the position data to determine whether the vehicle was at a predetermined location during a predetermined temporal window includes the steps of determining an arrival time that the vehicle arrived at each of the predetermined locations, and comparing the arrival time with the corresponding time window for that location, such that an exception report will be generated when the arrival time is not within the corresponding time window. Again, if desired, no exception report need be generated if the vehicle arrived at the predetermined location early.

In at least one embodiment, the position data is conveyed to a remote computer for analysis, such that analysis of the position data is performed externally of the vehicle. In a preferred but not limiting embodiment, the position data is available in a networked computing environment. In at least one embodiment, the position data is stored by a company offering data management services to its clients, and clients can access exception report data and position data for each of their vehicles.

In a preferred but not limiting embodiment, the position data is conveyed to the remote computer while the vehicle is traveling to the plurality of different locations, such that the analysis of the position data is performed in real-time, and the step of automatically generating the exception report for each location is performed in real-time. If desired, each exception report can be automatically forwarded to a dispatcher responsible for the vehicle via at least one of an email message, an instant message, a voicemail message, or a popup window on a computer assigned to the dispatcher.

Generally, a dispatcher or other manager is able to define the plurality of locations to be visited, and the corresponding time windows for each location. The time windows can be the same for each location, or different time windows can be assigned to each location. The duration of the time windows can be tailored to meet specific needs. A bus service, which is relied upon by commuters, may desire to define relatively narrow time windows (such as plus or minus several minutes), while a garbage removal service or parcel delivery may desire to define relatively broader time windows.

In addition to being implemented as a method, the concepts disclosed herein can also be implemented as a memory medium storing machine instructions that when executed by a processor implement the method, and by a system for implementing the method. In such a system, the basic elements include a vehicle that is to be operated by a vehicle operator, a route data collection unit (such as a GPS tracking device), a data link (which can be integrated into the GPS unit), and a remote computing device. In general, the remote computing device can be implemented by a computing system employed by an entity operating a fleet of vehicles. Entities that operate vehicle fleets can thus use such computing systems to track and process data relating to their vehicle fleet. It should be recognized that these basic elements can be combined in many different configurations to achieve the exemplary method discussed above. Thus, the details provided herein are intended to be exemplary, and not limiting on the scope of the concepts disclosed herein.

The above noted method is preferably implemented by a processor (such as computing device implementing machine instructions to implement the specific functions noted above) or a custom circuit (such as an application specific integrated circuit).

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 3:
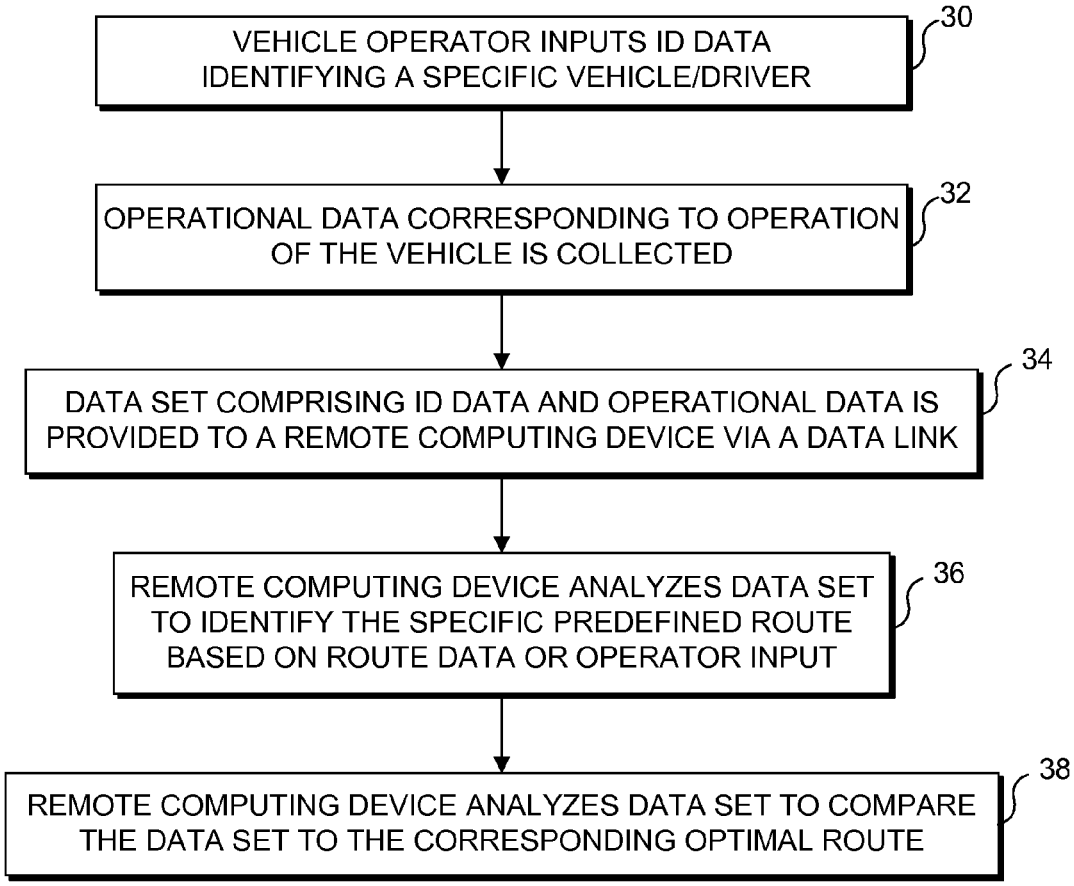
FIG. 3 is a flow chart showing method steps implemented in an exemplary embodiment in which a driver inputs data identifying the route, to facilitate identification of the corresponding optimal route data.
Figure 6:
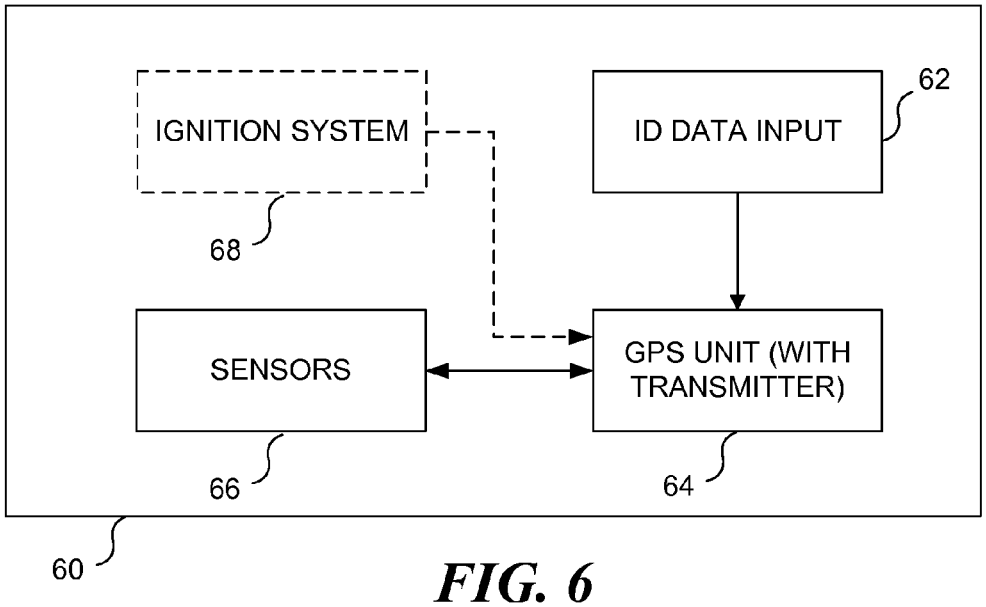
Figure 7:
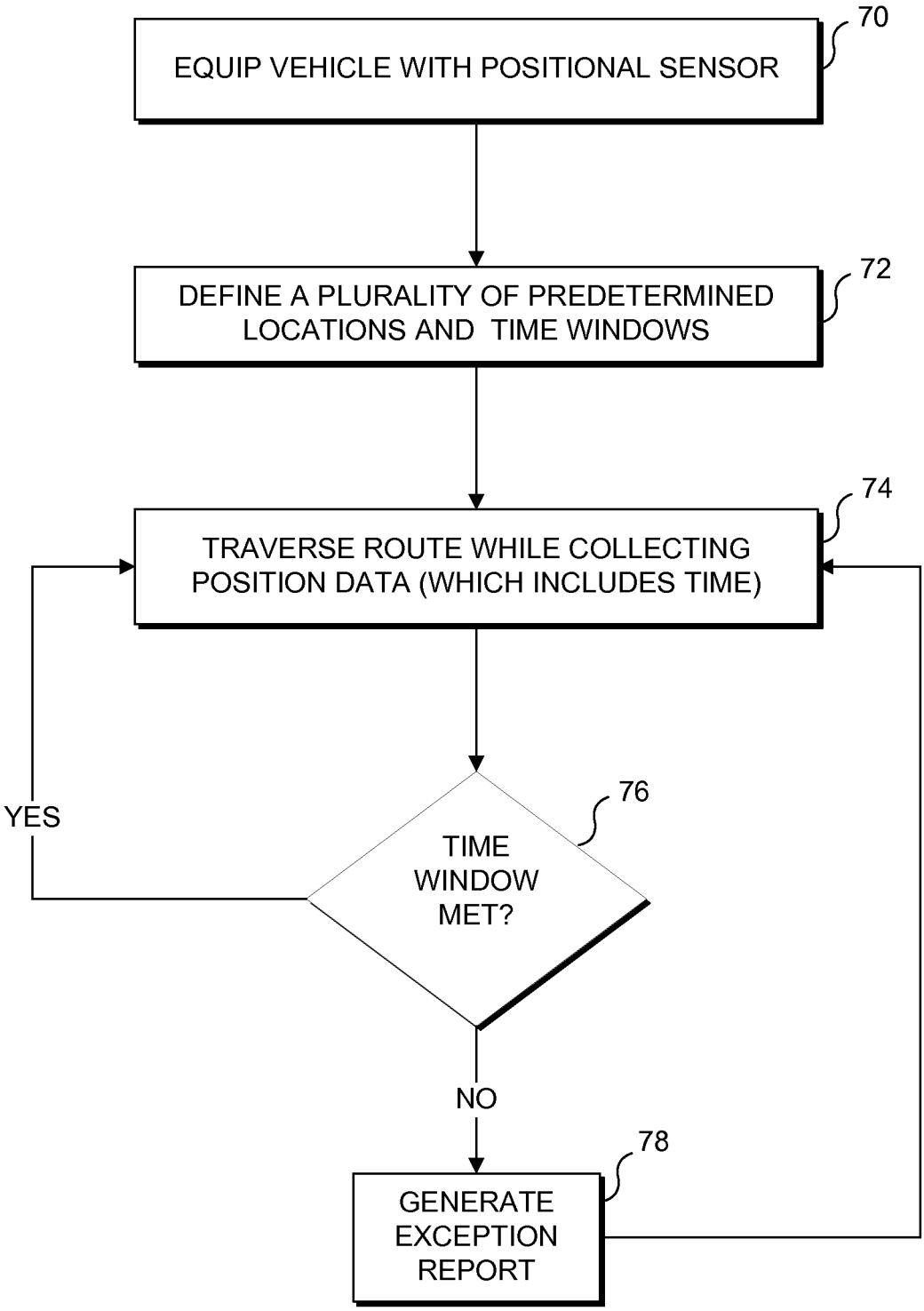

FIG. 6 is a schematic block diagram of a second exemplary vehicle configured to collect the geographical position data employed in the method steps of FIG. 3; and FIG. 7 is a high level logic diagram showing exemplary overall method steps implemented in accord with the concepts disclosed herein, and summarized above, to utilize geographical position data collected while a vehicle is traversing a route to generate an exception report whenever a vehicle does not arrive at a predetermined location during a predefined time window.

DESCRIPTION

Figures and Disclosed Embodiments are not Limiting

Exemplary embodiments are illustrated in referenced Figures of the drawings. It is intended that the embodiments and Figures disclosed herein are to be considered illustrative rather than restrictive. Further, it should be understood that any feature of one embodiment disclosed herein can be combined with one or more features of any other embodiment that is disclosed, unless otherwise indicated.

As used herein and in the claims that follow, the term specific route is intended to refer to a route between a starting location and an ending location that is intended to be traversed a plurality of times. For example, bus operators generally operate buses on a number of different specific routes, which are generally differentiated by a route number. A bus Route 51 might connect a shopping mall and an airport, while a bus Route 52 might connect the airport to a university. Route 51 and Route 52 are each different specific routes. A specific route may include one or more intermediate locations disposed between the starting location and the ending location, such intermediate locations representing geographical locations that the specific route intersects. A specific route may change over time; with intermediate locations being added or deleted from time to time. For example, bus Route 51 between the shopping mall and the airport may add or eliminate various bus stops between the airport and the shopping mall over time, but despite such changes, that bus route remains Route 51, a recognizable specific route. For any given specific route, there may be more than one possible path connecting the locations defining the specific route (a path being a set of geographical coordinates that can be navigated in a specific order to traverse a specific route). The term actual route data as employed herein and in the claims that follow refers to a set of data including the geographical coordinates (i.e., geographical position data) navigated by a vehicle as it traverses a specific route. Traversing a specific route using different paths will thus yield different actual route data. The term optimal route (and optimal route data), as used herein and in the claims that follow, refers to a set of data including the geographical coordinates corresponding to a particular path that has been identified as being preferred to other possible paths that can be used to traverse a specific route. In absolute terms, the optimal route may not be the best possible path, it simply is the path that has currently been defined as the optimal route. Preferably, when a better path is identified, the optimal route is redefined. Standards for evaluating whether one path (i.e., one set of actual route data) is better than another path are discussed in greater detail below.

Figure 1:
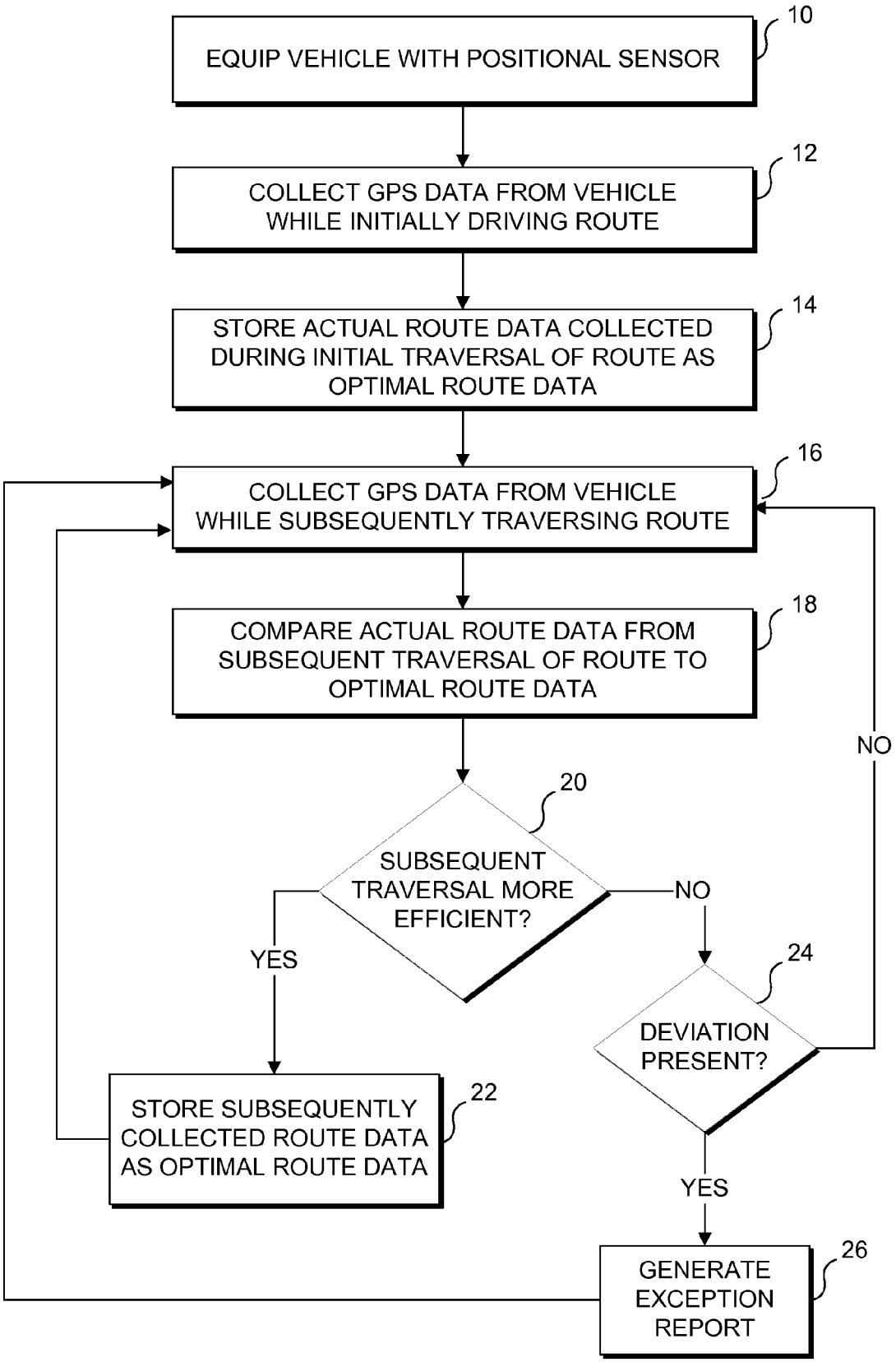
FIG. 1 is a high level logic diagram showing exemplary overall method steps implemented in accord with the concepts disclosed herein to utilize geographical position data collected while a vehicle is traversing a route to generate optimal route data, which can avoid the use of route planning software.

FIG. 1 is a high level flow chart showing the overall method steps implemented in accord with one aspect of the concepts disclosed herein, to utilize geographical position data collected from a vehicle traversing a specific route to determine optimal route data for that route. In a block 10, a vehicle is equipped with geographical position sensors (such as a GPS unit), so that geographical position data can be collected when the vehicle is being operated. In a block 12, the vehicle is operated to initially traverse a specific route with the GPS unit activated, and collects geographical position data corresponding to the specific route. As noted above, various techniques can be used to determine the initial route (i.e., the initial path). For example, the initial route can be planned using maps, local knowledge of roads and traffic patterns, with the use of route planning software (although in at least one embodiment, no route planning software is employed), or some combination thereof. In a block 14, the GPS data collected while traversing the route initially are stored (in at least one embodiment, the GPS data are stored as a "fingerprint" of different geographical positions encountered during traversal of the route) and are designated as the optimal route data (that is, it is assumed that the first traversal of the route corresponds to an initial optimal traversal of the route). Note that actual route data (i.e., GPS data) are used to define the optimal route. As noted above, in some embodiments, additional data collected while the vehicle traverses the route are included in the actual route data that is used to define the optimal route data. The additional data can include, but are not limited to, engine hours accumulated traversing the route, mileage traveled while traversing the route, engine temperature measured while traversing the route, oil temperature measured while traversing the route, coolant temperature measured while traversing the route, and engine RPMs measured while traversing the route.

In a block 16, the route is subsequently traversed again, also using a vehicle equipped to collect GPS data, and this subsequent traversal generates actual route data. In a block 18, the actual route data for the subsequent traversal are compared to the optimal route data. In a simple exemplary embodiment, such a comparison only determines the data that corresponds to the least time required to complete the route. If in a decision block 20, it is determined that the subsequent route data represents an improvement over the optimal route data (i.e., if the actual route data for the subsequent traversal is more efficient than the optimal route data), the previous optimal route data are replaced with the subsequent actual route data (i.e., the subsequent route data then becomes the new optimal route data) in a block 22. It should be recognized that many parameters other than time required to complete the route can be used to evaluate whether the subsequent traversal of the route was performed more efficiently than the alternative traversal of the route. Factors such as those identified above with respect to the additional data can be used to compare the optimal route data with subsequently obtained actual route data. Whenever an improvement is identified, the actual route data for the subsequent traversal of the route can automatically be applied to replace the optimal route data, or a route manager can be informed of the improvement, so that the route manager (or other pertinent individual tasked with making such a decision) can determine whether the optimal route data should be replaced with the subsequently obtained actual route data. Once the subsequently obtained actual route data are used to redefine the optimal route, then the method is ready to collect additional actual route data during yet another subsequent traversal of the route, as indicated by the link between block 22 and block 16.

Referring once again to decision block 20, if it is determined that the subsequent traversal of the route is not more efficient than the optimal route as defined by the optimal route data, then in a decision block 24, it is determined whether any deviations between the optimal route data and the actual route data collected in the subsequent traversal have occurred. Such deviations can include missed stops, additional mileage required to complete the route, additional time required to complete the route, higher engine RPMs required during completion of the route, more fuel required during completion of the route, higher engine temperature reached during completion of the route, higher oil temperature reached during completion of the route, higher coolant temperature reached during completion of the route, and/or that a predefined boundary based on the optimal route was breached (for example, the driver ran a personal errand, or took the vehicle home rather than to a fleet yard). If so, then in a block 26 an exception report is generated. The method is then ready to collect additional actual route data for the next (i.e., yet another) traversal of the route, as indicated by the link between block 26 and block 16. Note that generation of an exception report may result in a disciplinary action, if it is determined that a driver of the vehicle violated a fleet policy. In some cases, a deviation will be permissible, because the deviation was required due to traffic conditions, such as accidents or road construction. It should also be recognized that an exception report may not be generated until any deviation exceeds a predefined value. For example, a fleet operator may determine that any reduction in time required to complete a traversal of the route never requires an exception report (as such a reduction in time is generally considered beneficial). Other fleet operators may want exception reports generated even when the deviation represents an increase in efficiency, so that the route manager can study route data representing increases in efficiency. Still other fleet operators may allow deviations of up to a certain percentage change (or other predefined limit) before an exception report is issued, recognizing that regularly changing traffic patterns will cause subtle variations in the route data.

Referring once again to decision block 24, if no deviation is identified, then the method is ready to collect additional actual route data for yet another subsequent traversal of the route, as indicated by the link between block 24 and block 16.

Note that the method described above enables optimal route data to be initially defined, and then regularly dynamically updated when improvements are identified, without requiring the use of route planning software. It should also be recognized that some fleet operators may choose to intentionally vary a subsequent traversal of a route from the optimal route, in order to determine if the variation leads to an improvement. Such intentional variations can be instituted on a case-by-case basis (for example, when exception reports note a trend of decreasing efficiency over time, perhaps due to changes in long term traffic patterns, routes, or traffic volumes), or can be regularly (i.e., periodically) scheduled (e.g., on a weekly, bi-weekly, or monthly basis, it being understood that such intervals are intended to be exemplary and not limiting).

Fleet operators generally operate vehicles over a plurality of different routes. Several techniques can be used to enable optimal route data for a particular route to be correlated to actual route data collected during subsequent traversal of the route. The vehicle operator can input a route identifier (ID) into a data input device that is logically coupled with the geographical position sensor employed to track the vehicle's position as it traverses the route. The route ID can then be incorporated into the actual route data, such that when the actual route data are compared to the optimal route data, the route ID enables the corresponding optimal route data to be identified (because the corresponding optimal route data will include the same route ID). Alternatively, the actual route data can be compared to the optimal route data for all of the fleet operator's routes, until a best match is found. The geographical positions in each set of actual route data and in each set of optimal route data can be considered analogous to fingerprints, and conventional data processing techniques can be used to rapidly determine which set of optimal route data most closely corresponds to a set of subsequently obtained actual route data. Unless the subsequent traversal of a specific route varies significantly from the optimal route as defined by the optimal route data, the subsequently collected actual route data should be able to be matched to the corresponding optimal route data. It should be understood that the time window concept discussed in greater detail with respect to FIG. 7 (where a route includes a plurality of destinations, and the vehicle is scheduled to arrive at each destination within a predetermined time window) can be used to define a route fingerprint as well, such that the time a vehicle was at a particular location can also be used to distinguish different routes from one another.

Figure 2:
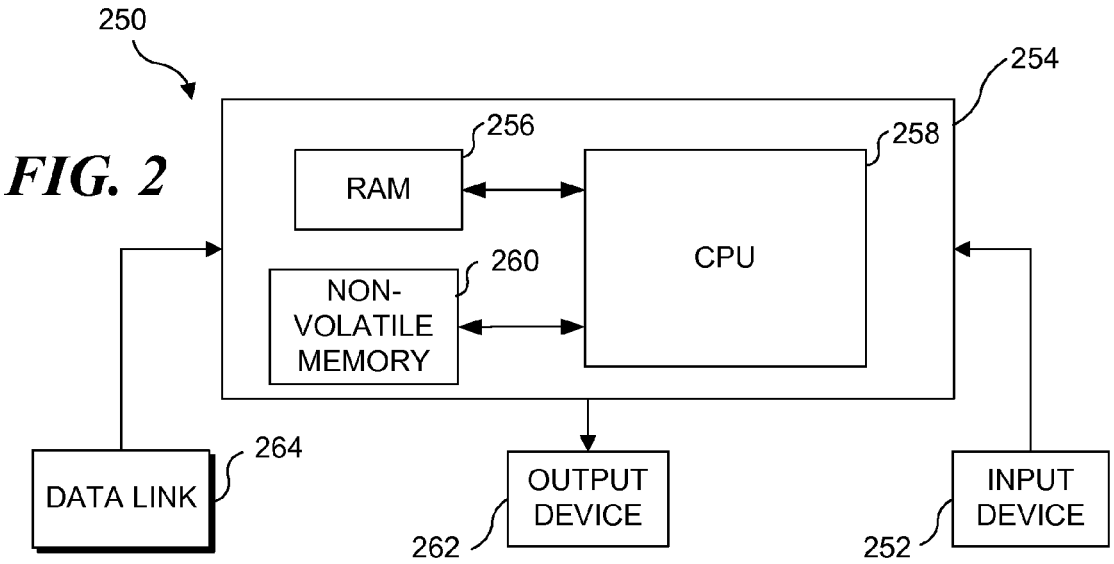
FIG. 2 is a functional block diagram of an exemplary computing device that can be employed to implement some of the method steps disclosed herein.

In general, analysis of the actual route data (i.e., comparing subsequently obtained actual route data to previously determined optimal route data) will be carried out by a remote computing device. The remote computing device in at least one embodiment comprises a computing system controlled or accessed by the fleet operator. The remote computing device can be operating in a networked environment, and in some cases, may be operated by a third party under contract with the fleet operator to perform such services. FIG. 2 schematically illustrates an exemplary computing system 250 suitable for use in implementing the method of FIG. 1 (i.e., for executing blocks 18, 20, 22, 24, and 26 of FIG. 1). Exemplary computing system 250 includes a processing unit 254 that is functionally coupled to an input device 252 and to an output device 262, e.g., a display (which can be used to output a result to a user, although such a result can also be stored). Processing unit 254 comprises, for example, a central processing unit (CPU) 258 that executes machine instructions for carrying out an analysis of data collected in connection with operation of the vehicle to determine how closely a subsequent traversal of a specific route corresponds to the optimal route. The machine instructions implement functions generally consistent with those described above with respect to blocks 18, 20, 22, 24, and 26 of FIG. 1, as well as those described below in a block 36 and a block 38, with respect to FIG. 3. CPUs suitable for this purpose are available, for example, from Intel Corporation, AMD Corporation, Motorola Corporation, and other sources, as will be well known to those of ordinary skill in this art.

Also included in processing unit 254 are a random access memory (RAM) 256 and non-volatile memory 260, which can include read only memory (ROM) and may include some form of memory storage, such as a hard drive, optical disk (and drive), etc. These memory devices are bi-directionally coupled to CPU 258. Such storage devices are well known in the art. Machine instructions and data are temporarily loaded into RAM 256 from non-volatile memory 260. Also stored in the non-volatile memory are an operating system software and ancillary software. While not separately shown, it will be understood that a generally conventional power supply will be included to provide electrical power at voltage and current levels appropriate to energize computing system 250.

Input device 252 can be any device or mechanism that facilitates user input into the operating environment, including, but not limited to, one or more of a mouse or other pointing device, a keyboard, a microphone, a modem, or other input device. In general, the input device will be used to initially configure computing system 250, to achieve the desired processing (i.e., to compare subsequently collected actual route data with optimal route data, to identify any deviations and/or efficiency improvements). Configuration of computing system 250 to achieve the desired processing includes the steps of loading appropriate processing software into non-volatile memory 260, and launching the processing application (e.g., loading the processing software into RAM 256 for execution by the CPU) so that the processing application is ready for use. Output device 262 generally includes any device that produces output information, but will most typically comprise a monitor or computer display designed for human visual perception of output. Use of a conventional computer keyboard for input device 252 and a computer display for output device 262 should be considered as exemplary, rather than as limiting on the scope of this system. Data link 264 is configured to enable data collected in connection with operation of a vehicle to be input into computing system 250 for subsequent analysis to compare subsequent route data with optimal route data, to identify any deviations and/or efficiency improvements. Those of ordinary skill in the art will readily recognize that many types of data links can be implemented, including, but not limited to, universal serial bus (USB) ports, parallel ports, serial ports, inputs configured to couple with portable memory storage devices, FireWire ports, infrared data ports, wireless data communication such as Wi-Fi and Bluetooth™, network connections via Ethernet ports, and other connections that employ the Internet.

FIG. 3 is a high level flow chart showing the overall method steps implemented in accord with another exemplary embodiment for comparing subsequent route data with optimal route data, to identify any deviations and/or efficiency improvements. In a block 30, a user (hereinafter referred to as the operator, since generally, the user will be the operator of the vehicle, although it should be recognized that other individuals, such as fleet maintenance personnel or supervisors can be assigned to carry out this and other tasks discussed herein) inputs route identification data into a memory, so that the route identification data can be combined with other data to generate a data set corresponding to a specific vehicle operated during a specific period of time. As noted above, such a route ID facilitates correlation of subsequently collected actual route data with previously identified optimal route data, enabling a comparison of the subsequent route data with the optimal route data to be made. In general, the memory can be incorporated into the vehicle (such as memory associated with an onboard computing device or a geographical positioning sensor, such as a GPS unit), or the memory can be associated with a portable electronic device (such as a portable electronic data collection device used by the operator to collect the other data). In a block 32, operational data corresponding to operation of the vehicle are collected. This data will at least include the geographical position data that is included in the actual route data. As described in greater detail below, other data can also be added to the actual route data. The other data can be collected before the vehicle is operated over a specific predefined route (such as pre-trip vehicle inspection data), or the other data can comprise operational/vehicle parameters collected during operation of the vehicle over a specific predefined route (data such as brake temperature data, engine temperature data, coolant temperature data, and tire pressure data, although it should be recognized that such types of data are intended to be exemplary rather than limiting on the scope of this approach), or both types of data. In a block 34, a data set (i.e., the actual route data) comprising the route ID data input by the operator, the geographical position data, and any other operational data (i.e., the other data—if used) is conveyed to a remote computing device via a data link. It should be recognized that, depending on the specific configuration of the vehicle, the data set can be conveyed after a trip over a specific predefined route has been completed, or in real-time while the route is being traveled by the vehicle (the real-time embodiment requires a vehicle to be equipped with a wireless communications data link) In a block 36, the data set is analyzed to identify a specific predefined route over which the vehicle has been operated (i.e., the data set is parsed to identify the route ID, which is then used to identify a particular one of the plurality of predefined routes over which the vehicle traveled, to enable the corresponding optimal route data to be identified). In a block 38, the corresponding optimal route data are compared with the actual route data, to identify any deviations and/or efficiency improvements. Generally as discussed above, if the actual route data represent an improvement over the optimal route data, the actual route data replace the optimal route data (i.e., a new optimal route is defined based on the subsequently collected actual route data representing the improvement). Exception reports can be generated to note any deviations between the subsequently collected actual route data and the optimal route data.

Figure 4:
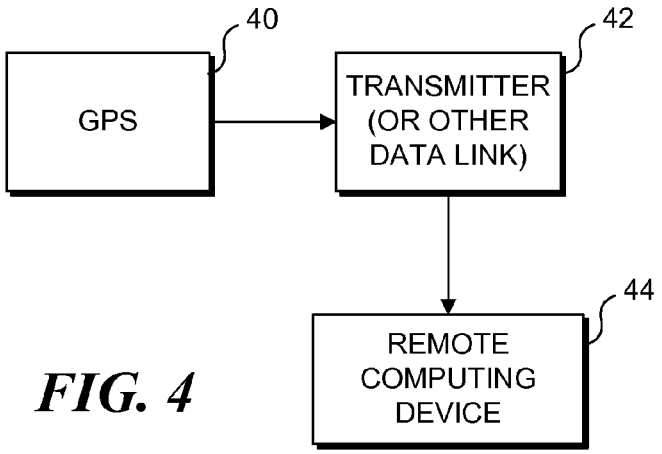
FIG. 4 is an exemplary functional block diagram showing the basic functional component used to implement the method steps of FIG. 1.

FIG. 4 is a schematic block diagram of exemplary functional components that can be employed to implement the method steps of FIG. 1. The components include a GPS unit 40, a transmitter 42, which may also have a corresponding receiver—not shown (or other data link), and a remote computing device 44 (generally as described above). It should be recognized that many GPS units are available that already incorporate a transmitter, such that a separate transmitter may not be required. It should be understood that the concepts disclosed herein can be used with other types of geographical position sensors/systems, and the use of the term GPS is intended to be exemplary, rather than limiting.

Figure 5:
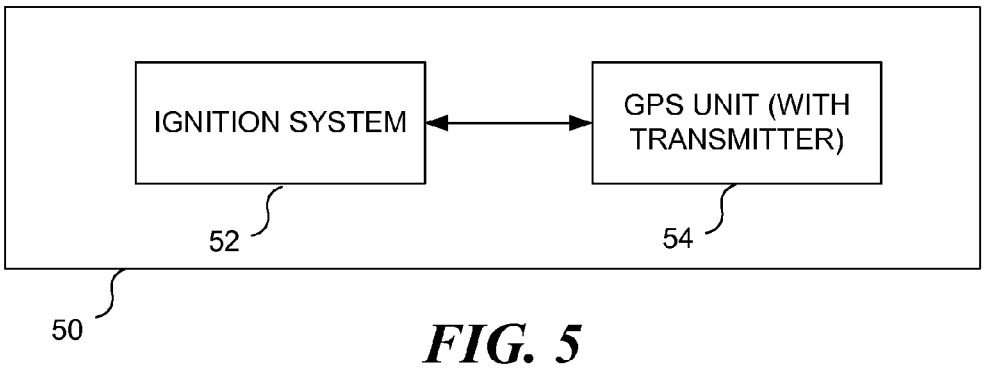
FIG. 5 is a schematic block diagram of a first exemplary vehicle configured to collect the geographical position data employed in the method steps of FIG. 1.

FIG. 5 is a schematic block diagram of an exemplary vehicle configured to collect the geographical position data employed in the method steps of FIG. 1. A vehicle 50 includes GPS unit 54 (which in this embodiment, includes a transmitter, although it should be recognized that a GPS unit without a transmitter can be coupled with a transmitter or other data link to achieve similar functionality). GPS unit 54 is coupled to ignition system 52, so that geographical position data are collected only when the ignition system is on (this configuration is intended to be exemplary, but not limiting).

FIG. 6 is a functional block diagram of exemplary functional components of a vehicle employed to implement the method steps of FIG. 3. A vehicle 60 includes GPS unit 64 (which in this embodiment, includes a transmitter, although it should be recognized that a GPS unit without a transmitter can be coupled with a transmitter or other data link to achieve similar functionality). GPS unit 64 is optionally coupled to ignition system 68, so that geographical position data are collected only when the ignition system is on (such a configuration is intended to be exemplary, but not limiting). Vehicle 60 further includes sensors 66, and an ID data input 62.

In general, route identification data input 62 comprises a keyboard or function keys logically coupled to GPS unit 64. It should be recognized, however, that other data input structures (i.e., structures other than keyboards) can instead be implemented, and that the concepts disclosed herein are not limited to any specific identification data input device. The operator can also use a handheld electronic data collection device to scan a token that uniquely corresponds to a specific one of the plurality of the predefined routes. For example, the operator can be provided with a plurality of tokens, each of which uniquely corresponds to a different one of the plurality of predefined routes, such that the user selects the appropriate token, and uses the handheld electronic data collection device to scan the appropriate token to input the ID for the selected route. Many different tokens/sensor combinations can be implemented. Barcodes and optical scanners represent one combination, while radio frequency identification (RFID) tags and RFID readers represent another such combination. The advantage of a token/sensor combination is that the handheld electronic data collection device is not required to incorporate a keypad for entry of the route identification data. As a further alternative, the route identification data can be entered verbally, using voice recognition software that can recognize and interpret the verbal input. In embodiments where the route identification data are entered into a portable electronic data collection device, the portable electronic data collection device can also be employed to collect other operational/vehicle data (i.e., operational data other than GPS data, monitored by sensors 66). Alternatively, the other operation data collected from sensors 66 can be conveyed to an onboard computer, or to GPS unit 64, to be combined with the GPS data and the route ID data, to provide the actual route data for transmittal to the remote computing device. The other operational data can include inspection data and/or data collected from sensors incorporated into the vehicle (e.g., sensors configured to collect data such as engine temperature data, oil temperature data, brake temperature data, tire pressure data, and tire temperature data, it being understood that such types of data are intended to be exemplary, rather than limiting).

It should be recognized that alternative configurations to enable the actual route data for a subsequent traversal of a specific route to be conveyed to a remote computer can be employed. For example, GPS data and the route ID data can be stored in an onboard computer, and then conveyed to a remote computer by a variety of different data links, including hard wired data transmission, wireless data transmission, and data transmission accomplished by carrying a portable data storage device from the vehicle to the site of the remote computer. The specific type of data link employed is not significant. Those of ordinary skill in the art will recognize that data can be communicated in a variety of different ways, including, but not limited to, via serial data ports, parallel data ports, USB data ports, infrared communication ports, Firewire ports, and/or using radio frequency transmitter/receivers that are linked in communication.

FIG. 7 is a high level logic diagram showing exemplary overall method steps implemented in accord with the concepts disclosed herein, and summarized in the Summary of Invention section above, to utilize geographical position data collected while a vehicle is traversing a route to generate an exception report whenever a vehicle does not arrive at a predetermined location during a predefined time window.

In a block 70, a vehicle is equipped with geographical position sensors (such as a GPS unit), so that geographical position data can be collected when the vehicle is being operated. In a block 72, a route including a plurality of predetermined locations is defined, with a time window being assigned to each predetermined location. The duration of the time window for each predetermined location can be varied to suit the needs of the user. An operator of a bus fleet will likely desire relatively narrow time windows (such as time windows on the order of a few minutes or less in duration), whereas an operator of a fleet of refuse collection vehicles may be comfortable with relatively broader time windows. The time window can be defined as a specific point in time T, plus or minus (or both) an amount X.

In a block 74, the defined route is traversed using the vehicle equipped to collect GPS data or position data, which identifies a specific geographical location of the vehicle at a specific point in time. The resolution of the position data can vary. The position data can be collected every second, which will generate a relatively large data set. The position data can be collected every minute, which will generate a relatively smaller data set. These time resolutions are simply exemplary, and are not intended to be limiting. The time resolution controlling the frequency of the position data collection should be selected such that the frequency is smaller than the time window.

Once the position data is collected, it is automatically analyzed to generate an exception report whenever a vehicle does not arrive at a predetermined location during a predefined time window, using a computing device or a custom circuit. While the position data could be analyzed by such a processor onboard the vehicle, in general the position data will be conveyed via a data link to a remote computing device. If the position data is conveyed to the remote computing device in real time (by using a wireless data link) the analysis can be performed in real-time, to alert dispatchers of problems encountered in meeting the route schedule in real-time.

An exemplary analysis in indicated in a decision block 76, wherein for each predetermined location it is determined whether the time window was met. If not, then an exception report is generated in a block 78. The logic then terminates or loops back (as shown) to a block 74 where additional position data is collected. If in decision block 76 it is determined that the time window was met for the predetermined location, then the logic terminates or loops back (as shown) to a block 74 where additional position data is collected.

The exception reports have several uses. They may be used to counsel or discipline drivers who do not pay sufficient attention to executing their assigned routes properly. However, they can also indicate that the predetermined route is unworkable, and should be modified (perhaps due to changes in traffic patterns or weather conditions).

As discussed generally above, route ID data and data identifying specific drivers can be included in the position data, such that the exception reports can uniquely identify specific drivers and specific routes.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

The invention in which an exclusive right is claimed is defined by the following:

1. A system for analyzing position data from a vehicle equipped with a geographical position system to determine if the vehicle has adhered to a predetermined schedule, where the vehicle is scheduled to arrive at each one of a plurality of predetermined locations during a corresponding predetermined time window, the position data identifying a specific geographical location of the vehicle at a specific point in time, the system comprising:

(a) a non-transitory memory remote from the vehicle, in which a plurality of machine instructions are stored;

(b) a data link for communicating the position data collected at the vehicle while operating the vehicle; and (c) a processor remote from the vehicle and logically coupled to the memory and to the data link, said processor executing the machine instructions to carry out a plurality of functions, including:

(i) analyzing the position data to determine whether the vehicle was at each predetermined location during the corresponding predetermined time window; and (ii) automatically generating an exception report for each instance that the vehicle was not at one of the plurality of predetermined locations during the corresponding time window; and (iii) analyzing the exception reports to determine a cause for the exceptions, and a course of action for improving ongoing vehicle operations.

2. The system of claim 1, wherein the "plurality of functions further include automatically delivering each exception report to a dispatcher responsible for the vehicle via at least one of an email message, an instant message, a voicemail message, or a popup window on a computer assigned to the dispatcher.

3. The system of claim 1, wherein the plurality of functions further include enabling a dispatcher responsible for the vehicle to define the temporal window for each location, such that each temporal window can be identical in duration or different in duration.

4. The system of claim 1, wherein the machine instructions, when executed by a processor, analyze the position data to determine whether the vehicle was at each predetermined location during the corresponding predetermined time by performing the steps of:

(a) for each time window, determining an actual geographic position of the vehicle during that time window; and (b) for each time window, comparing the actual geographic position of the vehicle with the plurality of predetermined locations, such that an exception report will be generated when the actual geographic position of the vehicle during the time window does not correspond to one of the plurality of predetermined locations.

5. The system of claim 1, wherein the machine instructions, when executed by a processor, analyze the position data to determine whether the vehicle was at each predetermined location during the corresponding predetermined time by performing the steps of:

(a) for each of the plurality of predetermined locations, determining an arrival time that the vehicle arrived at the location; and (b) for each of the plurality of predetermined locations, comparing the arrival time with the corresponding time window for that location, such that an exception report will be generated when the arrival time is not within the corresponding time window.

6. A method for analyzing position data from a vehicle equipped with a geographical position system to determine if the vehicle has adhered to a predetermined schedule, where the vehicle is scheduled to arrive at each one of a plurality of predetermined locations during a corresponding predetermined time window; the method comprising the steps of:

(a) collecting position data from the vehicle as it travels to the plurality of different locations, the position data identifying a specific geographical location of the vehicle at a specific point in time;

(b) analyzing the position data to determine whether the vehicle was at each predetermined location during the corresponding predetermined time window; and (c) automatically generating an exception report for each instance that the vehicle was not at one of the plurality of predetermined locations during the corresponding time window, except when the position data indicates that the vehicle arrived at the predetermined location early, in which case no exception report will be generated for an early arrival.

7. The method of claim 6, wherein the exception reports identify the driver.

8. The method of claim 6, wherein the exception reports identify the route driven.

9. The method of claim 6, wherein the exception reports are analyzed to determine viability of the route.

10. A method for analyzing position data from a vehicle equipped with a geographical position system to determine if the vehicle has adhered to a predetermined schedule, where the vehicle is scheduled to arrive at each one of a plurality of predetermined locations during a corresponding predetermined time window; the method comprising the steps of:

(a) collecting position data from the vehicle as it travels to the plurality of different locations, the position data identifying a specific geographical location of the vehicle at a specific point in time;

(b) after the vehicle has completed its predetermined schedule, analyzing the position data to determine whether the vehicle was at each predetermined location during the corresponding predetermined time window; and (c) automatically generating an exception report for each instance that the vehicle was not at one of the plurality of predetermined locations during the corresponding time window.

11. The method of claim 10, wherein the step of comparing the actual geographic position of the vehicle with the plurality of predetermined locations comprises the step of ignoring any actual geographic position of the vehicle if the position data collected from the vehicle indicates that the vehicle arrived at the predetermined location corresponding to the specified time window at an earlier point in time, such that no exception report will be generated when the vehicle arrived at the corresponding predetermined location early.

12. The method of claim 10, wherein the step of analyzing the position data to determine whether the vehicle was at a predetermined location during a predetermined time window comprises the steps of:

(a) for each of the plurality of predetermined locations, determining an arrival time that the vehicle arrived at the location; and (b) for each of the plurality of predetermined locations, comparing the arrival time with the corresponding time window for that location, such that an exception report will be generated when the arrival time is not within the corresponding time window.

13. The method of claim 12, wherein the step of comparing the arrival time with the corresponding time window for that location comprises the step of ignoring any arrival time that is earlier than the corresponding time window, such that no exception report will be generated for an early arrival time.

* * * * *